United States Patent [19]

Doane

[11] 4,189,973

[45] Feb. 26, 1980

[54] ELECTRONIC EXPRESSION CONTROL

[75] Inventor: Patrick K. Doane, Jasper, Ind.

[73] Assignee: Kimball International, Inc., Jasper, Ind.

[21] Appl. No.: 813,834

[22] Filed: Jul. 8, 1977

[51] Int. Cl.[2] ..... G10H 1/02; G10H 5/00

[52] U.S. Cl. ..... 84/1.27; 179/1 A; 179/1 VL; 330/126; 330/130; 330/131; 330/151

[58] Field of Search ..... 84/1.01, 1.09–1.11, 84/1.19, 1.24–1.27, DIG. 9; 179/1 A, 1 VL; 330/124 R, 126, 130, 131, 144, 151

[56] References Cited

U.S. PATENT DOCUMENTS

| | | | |
|---|---|---|---|
| 3,749,809 | 7/1973 | Niinomi | 84/1.24 |
| 3,787,602 | 1/1974 | Okudaira | 84/1.24 |
| 3,848,092 | 11/1974 | Shamma | 179/1 VL |
| 3,886,836 | 6/1975 | Hiyoshi | 84/1.26 |
| 3,911,776 | 10/1975 | Beigel | 84/1.24 X |
| 4,038,898 | 8/1977 | Kniepkamp et al. | 84/1.24 |

*Primary Examiner*—S. J. Witkowski

*Attorney, Agent, or Firm*—Albert L. Jeffers; John F. Hoffman

[57] ABSTRACT

An electronic organ in which a manually adjustable potentiometer varies the control voltage supplied to a voltage controlled amplifier interposed between a source of tone signals and an organ output circuit with the potentiometer being connected to the amplifier by a circuit which eliminates scratching and discontinuity in the potentiometer output. The amplifier can be bypassed by circuitry for supplying lower frequency bass signals to the amplifier output under conditions of high attenuation of the incoming signal in the amplifier.

20 Claims, 2 Drawing Figures

ELECTRONIC EXPRESSION CONTROL

The present invention relates to an electronic expression control for electronic organs and is concerned with an expression control circuit which eliminates the physical limitations of mechanical potentiometers which are conventionally employed for the purpose of expression control.

Expression control in an electronic organ is normally the control which varies the strength of the signal supplied to the output circuitry of the organ. Many times, the expression control is in the form of a potentiometer connected between the signal path and ground and variable for bypassing more or less of the signal to ground.

Potentiometers of the nature referred to can, of course, be used in other places in the circuitry to adjust the strength of the signals supplied to the output circuitry of the electronic organ.

Potentiometers of the nature referred to are notorious in respect of producing scratchy sounds and for being discontinuous in respect of resistance value so that, in operating such a potentiometer, the sound output of the organ is apt to change suddenly in volume and also to exhibit scratchy sounds as the potentiometer is moved. Such conditions in the potentiometer are likely to develop after the potentiometer has been used for a long period of time but can be present in new manufacture.

The present invention proposes an expression control circuit which will eliminate the drawbacks referred to above by interposing variable circuitry in the signal path with the circuitry under the control of a manually controlled potentiometer. The potentiometer circuit compensates for any tendency of the potentiometer to produce a scratchy output and will also compensate for sudden changes in the potentiometer output.

BRIEF SUMMARY OF THE INVENTION

According to the present invention, a signal may be developed on any one or more of the solo, accompaniment and pedal manuals of an organ and after being keyed and voiced is supplied via an expression control circuit according to the present invention to the organ output circuitry consisting of amplifier means and loudspeaker means.

The electronic expression control circuitry according to the present invention consists of an operational amplifier having voltage controlled gain to which the tone signal, which is variable in frequency over a wide range and which is often, also, of mixed frequency, is supplied and a fixed gain amplifier connected between the output of the voltage controlled amplifier and the organ output circuitry.

The variable voltage for supply to the voltage controlled amplifier is derived from a transistorized circuit in which a transistor has the collector-emitter path connected between a source of control voltage and the gain control terminal of the amplifier with a manually variable expression control potentiometer controlling the value of the biasing voltage at the base terminal of the transistor.

The potentiometer circuitry includes a source of biasing voltage and diode means and a resistor interposed between the source and the base terminal of the transistor with an electrolytic capacitor connected between the base terminal and ground and with the manually controlled potentiometer connected in parallel with the electrolytic capacitor.

The combination of a single voltage controlled amplifier and a fixed gain amplifier in series can be employed for handling all signals but it is advantageous to provide two or more such modules for handling different ranges of frequencies or different characters of tone signals.

In any case, it is advantageous to bypass the voltage controlled amplifier by circuitry which will permit a significant amount of the bass, or lower frequency, signals to bypass the amplifier under lower gain conditions of the amplifier.

More specifically, the bass boost circuitry acts, first, as a Fletcher and Munson compensator and, second, to simulate the action of the swell shutters of a conventional organ. As is known, as swell shutters close, the tones become muffled, which is the effect simulated by the bass boost circuitry.

The exact nature of the present invention will become more clearly apparent upon reference to the following detailed specification taken in connection with the accompanying drawings in which.

DETAILED DESCRIPTION OF THE INVENTION

Figure 1:
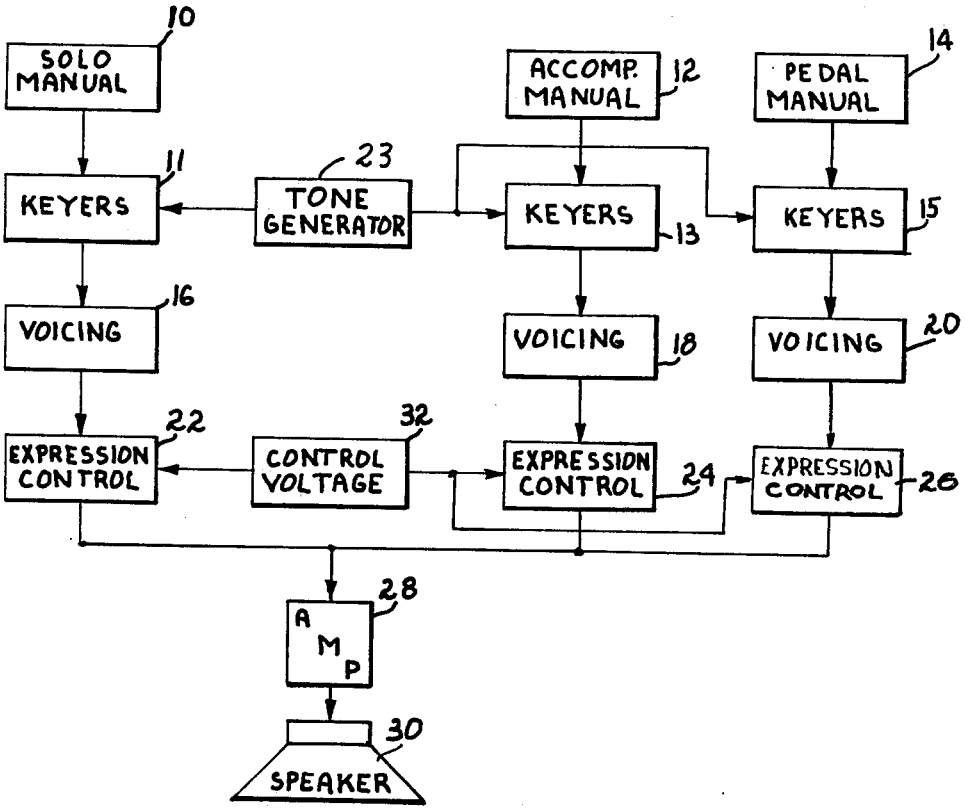
FIG. 1 is a schematic view showing an electronic organ incorporating electronic expression control circuitry according to the present invention.

Referring to the drawings somewhat more in detail, FIG. 1 schematically shows a solo keyboard or manual at 10, an accompaniment manual or keyboard at 12, and a pedal keyboard or clavier at 14. Keyboards 10 and 12 supply respective keyers 11 and 13 and pedals 14 may control keyers 15 which, according to known practice, produce chords or automatic rhythm patterns or the like.

Each of keyers 11 and 13 and the keyers 15 is followed by respective voicing circuit means 16, 18 and 20 within which the tone signals supplied to the keyers from tone generator 23 are shaped to the desired configuration.

The circuitry also involves electronic expression controls 22, 24 and 26 in conformity with the present invention, each having an input side supplied by a respective one of the voicing circuits 16, 18 and 20 and having output terminals connected via amplifier means 28 to speaker means 30. All of the electronic expression control circuits 22, 24 and 26 are under the control of a single potentiometer control circuit 32.

Figure 2:
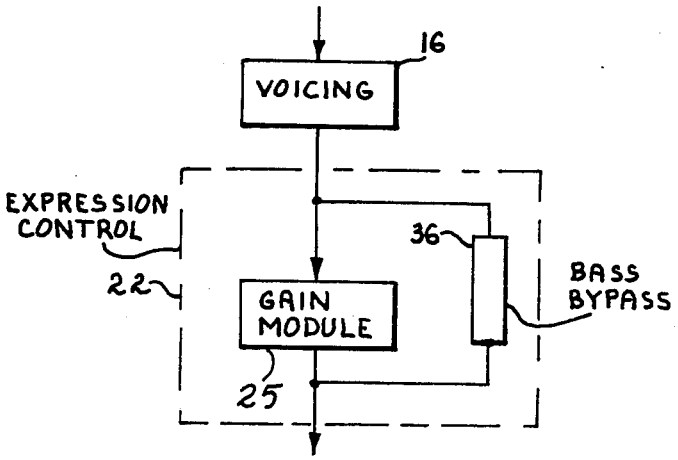
FIG. 2 is a fragmentary view showing the expression control circuitry somewhat more in detail.

FIG. 2 shows somewhat more in detail one of the electronic expression control circuits. It will be seen that the particular control circuit 22 illustrated comprises a gain module 25 having connected in bypassing relation thereto circuitry indicated at 36 and which, it will be seen hereinafter, comprises means for enhancing the bass quality of the output signal from circuit 22 under conditions of high attenuation of the incoming signal.

Figure 3:
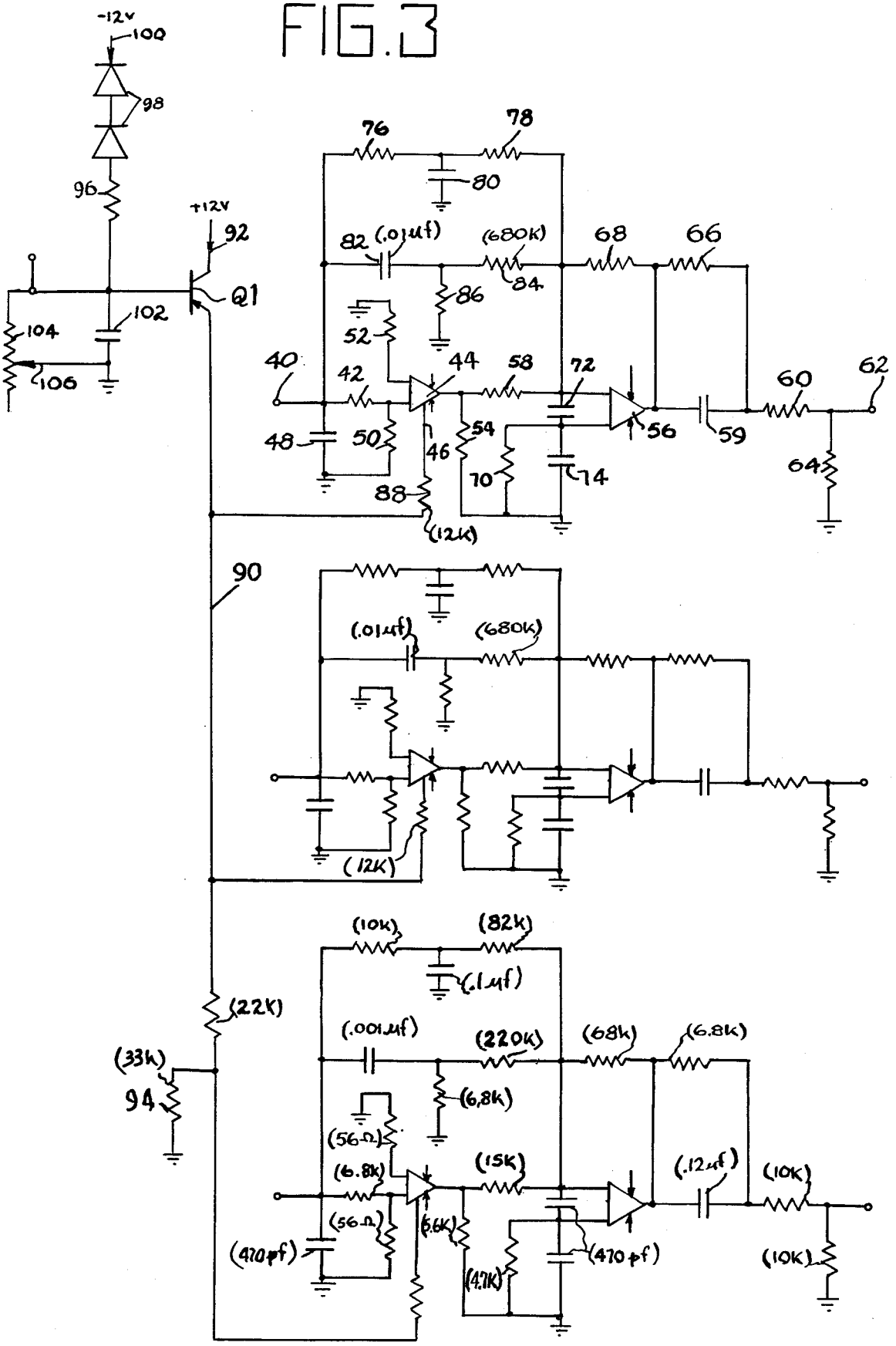
FIG. 3 is a detailed showing of the expression control circuitry according to the present invention.

Referring now to FIG. 3, a group of typical electronic expression controls in conformity with the present invention are illustrated. It will be understood that, as mentioned, a single circuit could process all of the organ signals but, due to the wide range of frequencies and types of signals provided, for example, by different organ voices, it is advantageous to provide each organ with a group of electronic expression controls according to the present invention and to route designated signals through each thereof.

The expression control circuits of FIG. 3 are quite similar and only one thereof will be described in detail. In FIG. 3, reference numeral 40 designates a signal input terminal which is connected via resistor 42 to the signal input terminal of an operational amplifier 44 having a voltage sensitive gain control terminal at 46. The signal input terminal 40 is connected to ground via a capacitor 48 and the signal input terminal of amplifier 44 is connected to ground via a resistor 50. The other input terminal of amplifier 44 is also connected to ground via a resistor 52.

The signal output terminal of amplifier 44 is connected to ground via a resistor 54 and to one terminal of a fixed gain operational amplifier 56 by a resistor 58.

The signal output terminal of amplifier 56 is connected via capacitor 59 and resistor 60 with output terminal 62 which is connected to the output circuitry of the organ. Terminal 62 is connected to ground via resistor 64 and a resistor 66 is connected in parallel relation to capacitor 54. A further resistor 68 is connected between the signal input terminal and the signal output terminal of amplifier 56 while the other input terminal of amplifier 56 is grounded by resistor 70. A capacitor 72 is connected between the input terminals of amplifier 56 with a further capacitor 74 connected in parallel with resistor 70.

The signal input terminal 40 pertaining to amplifier 44 is connected to the signal input terminal of fixed gain amplifier 56 via a bypass consisting of two parallel branches, the one containing serially arranged resistors 76 and 78 with the juncture thereof connected to ground by capacitor 80, and a second branch consisting of capacitor 82 and resistor 84 in series with the juncture thereof connected to ground via resistor 86.

The gain of amplifier 44 is current controlled by a variable current supplied thereto via resistor 88 which is connected between the voltage sensitive control terminal 46 and wire 90 which is connected to the emitter of transistor Q1, the collector of which is connected to a source of plus 12 voltage at 92. Wire 90 is connected to ground via a resistor 94.

The base terminal of transistor Q1 is connected via a resistor 96 and diode means 98 poled away from the base terminal of transistor to a source of transistor biasing voltage at 100. Transistor Q is an npn transistor and the source of biasing voltage therefor is at minus 12 volts.

The base terminal of transistor Q1 is connected to ground via a low impedance path, such as an electrolytic capacitor 102. The base terminal of transistor Q1 is also connected to one end of a resistor element 104 with a grounded slider 106 slidable along the element.

The other expression control circuits illustrated in FIG. 3 are the same as the one described above except for differences encountered in respect of the values of specific ones of the individual elements in the circuits. The specific values of the elements are marked on the lowermost branch of the circuit in FIG. 3. The values in the other branches are the same except where marked with a different value.

In operation, the electronic expression control consisting of amplifiers 44 and 56 and the circuit components connected thereto attenuate the mixed frequency signal supplied to signal input terminal 40 in conformity with the voltage supplied to gain control terminal 46 from the transistorized circuit embodying transistor Q1 and under the control of the potentiometer consisting of resistance element 104 and slider 106.

The bypass circuitry connected in parallel with amplifier 44 provides a bass signal bypass which is effective when the attenuation of the incoming signal is near maximum. The bypass circuitry maintains the output from the expression control circuitry in balance and prevents the bass portion thereof from being lost under conditions of maximum attenuation of the incoming signal.

Specifically, resistors 76 and 78 and capacitor 80 in parallel with capacitor 82 and resistors 84 and 86 comprise the bass boost portion of the circuitry. Capacitor 80, as is well known, acts as an open circuit for DC signals and as a closed circuit for high frequency signals, with a corresponding decrease in resistance between DC and high frequency. As the input frequency increases, capacitor 80 will shunt more and more of the signal to ground, which is the same as attenuating the treble portion of the signal and giving more preference to the bass. This effect is much more pronounced at low volumes when amplifier 44 is attenuating the input signal to a greater degree and most of the signal flows through the bypass shunt circuit comprising resistors 76, 78, 84 and 86 and capacitors 80 and 82. The output of the bass boost shunt is connected to the input of amplifier 56.

The electronic expression control circuit according to the present invention provides for substantially true linearization of the response from the expression control potentiometer, which is usually foot operated.

The mechanical problems in the form of undesired scratching and sudden changes in value of conventional expression potentiometers are eliminated by, in particular, stabilizing the voltage supplied to the base of the transistor through the use of the electrolytic capacitor.

The flexibility embodied in the present system adapts the system to as many channels as may be desired while, furthermore, the expression control circuitry according to the present invention can be tailored to the specific characters of the signals where desired or needed.

Modifications may be made within the scope of the appended claims.

What is claimed is:

1. A circuit for effecting expression control in an electronic organ or the like comprising:

variable gain amplifier means having a signal input terminal and a signal output terminal, said amplifier means having gain control terminal means separate from said input terminals so that signals on said control terminal means are not joined with any signal on said input terminal, a source of control voltage, a player controlled circuit connected between said source of control voltage and said control terminal means, said player controlled circuit comprising a transistor connected between said source of voltage and said control terminal means, a potentiometer connected to a control terminal of said transistor, said potentiometer comprising a slider engaging and movable along a resistor element, a high frequency low impedence shunt means including a capacitor, said shunt means being connected to a point between said potentiometer means and said transistor controlled terminal for smoothing out sudden changes in potentiometer output as sensed by said transistor control terminal and for shunting away from said transistor control terminal the high frequency components present in any scratch produced by said potentiometer, said amplifier means including means associated with said control terminal means for controlling the gain of said amplifier means in response to said control terminal.

2. The circuit of claim 1 wherein said transistor control terminal is connected to one end of said potentiometer resistor element, the other end of said resistor element is connected to ground through said slider, and said capacitor is connected between said slider and said transistor control terminal.

3. The circuit of claim 1 including a plurality of said amplifier means connected to said player controlled circuit.

4. The circuit of claim 1 including bypass circuit means in parallel with said amplifier means for bypassing lower frequency signals from said input terminal to said output terminal around said amplifier means during low gain conditions of said amplifier means.

5. A circuit for effecting expression control of a mixed or variable frequency signal comprising: current controlled amplifier means having signal input terminal means and signal output terminal means and current sensitive gain control terminal means, means for supplying said signal to said signal input terminal means, a source of control voltage, adjustable means connecting said source of control voltage to said gain control terminal means, and bypass circuit means in parallel with said amplifier means for automatically bypassing lower frequency signals from said input terminal to said output terminal around said amplifier means during low gain conditions of said amplifier means.

6. A circuit according to claim 5 in which said adjustable means includes transistor means having the collector-emitter path interposed between said source of control voltage and said gain control terminal means and manually adjustable potentiometer means connected to the base terminal means of said transistor means.

7. A circuit according to claim 5 which includes fixed gain amplifier means interposed between said signal output terminal means and output circuit means.

8. A circuit according to claim 5 in which said amplifier means comprises at least two amplifiers each having a signal input terminal and a signal output terminal and a current sensitive gain control terminal, a respective source of signals connected to each input terminal, said adjustable means comprising a transistor having one end of the collector-emitter path connected to said source of control voltage, resistor means connecting each gain control terminal and ground to the other end of said collector-emitter path, and control means for variably biasing the base terminal of said transistor.

9. A circuit according to claim 8 in which said control means comprises a source of bias voltage for the transistor, diode means and resistor means in series connecting said source of bias voltage to the base terminal of said transistor, a low impedance path connecting said base terminal to ground, a resistor element having one end connected to said base terminal, and a grounded slider engaging and movable along said resistor element.

10. In an electronic organ having tone generator means for supplying electrical control signals, output circuit means for converting the tone signals into audible sounds, and keyboard actuated means for controlling the tone generator means, an expression control circuit comprising:

variable gain amplifier means having a signal input terminal for receiving the electrical tone signals, an output terminal connected to said output circuit means, and a control terminal, means for supplying an electrical control signal to said control terminal, player actuated control means for adjusting the control signal supplied to said control terminal, said amplifier means including means associated with said control terminal for controlling the gain of said amplifier means in response to said control signal, and bypass circuit means in parallel with said amplifier means for automatically bypassing lower frequency signals from said input terminal to said output terminal around said amplifier means during low gain conditions of said amplifier means.

11. The electronic organ of claim 10 wherein said player actuated control means is a pedal operated potentiometer and said means for supplying an electrical control signal includes a DC source and filter means between said potentiometer and said control terminal for blocking AC.

12. The electronic organ of claim 10 wherein said means for bypassing comprises a resistor-capacitor circuit shunting said amplifier means.

13. The electronic organ of claim 10 wherein said means for bypassing becomes increasingly effective in proportion to the decrease in gain of said amplifier means.

14. The method of electronically attenuating tone signals supplied to the output circuitry of an electronic organ comprising:

supplying the tone signals to the input of a variable attenuation input-output device having a control terminal sensitive to an electrical control signal, supplying the output of the attenuation device to the output circuitry of the organ, supplying a DC control signal to the control terminal to thereby control the gain of the attenuation device, varying the control signal by means of a player actuated control device, and bypassing lower frequency tone signals from the input to the output around the variable attenuation device during periods of high attenuation conditions of the device.

15. The method of claim 14 including filtering any AC component of the control signal between the control device and the control terminal.

16. The method of claim 14 wherein the attenuation device is a variable gain amplifier and including interposing the collector-emitter path of a transistor between a source of control voltage and the control terminal, and variably biasing the base terminal of the transistor.

17. The method according to claim 16 which includes variably biasing the base terminal of said transistor by connecting a source of bias voltage via diode means and a resistor with the transistor base terminal and connecting the base terminal to ground via a low impedance path, connecting a variable resistor in parallel with said low impedance path, and varying said variable resistor to vary the conductivity of said transistor.

18. The method according to claim 16 which includes interposing a fixed gain amplifier between the output of the first mentioned amplifier and the output circuitry of said organ.

19. The method according to claim 16 which includes a current controlling resistor interposed between said control terminal and said transistor.

20. The method according to claim 10 which includes providing a second said amplifier having a control terminal means, supplying a plurality of tone signals to respective said amplifiers and supplying a signal source of variable control voltage to the respective control terminal means of said amplifiers.

* * * * *

UNITED STATES PATENT AND TRADEMARK OFFICE

CERTIFICATE OF CORRECTION

PATENT NO. : 4,189,973

DATED : February 26, 1980

INVENTOR(S) : PATRICK K. DOANE

It is certified that error appears in the above-identified patent and that said Letters Patent are hereby corrected as shown below:

Claim 20, Column 7, Line 6, change "10" to --16--.

Signed and Sealed this

*First* Day of *July 1980*

[SEAL]

*Attest:*

SIDNEY A. DIAMOND

*Attesting Officer*

*Commissioner of Patents and Trademarks*